US007737902B2

(12) United States Patent
Thudor et al.

(10) Patent No.: US 7,737,902 B2
(45) **Date of Patent: *Jun. 15, 2010**

(54) DIVERSITY RECEPTION SLOTTED FLAT-PLATE ANTENNA

(75) Inventors: Franck Thudor, Rennes (FR); Françoise Le Bolzer, Rennes (FR); Philippe Minard, Saint Medard sur Ille (FR)

(73) Assignee: Thomson Licensing, Boulogne-Billacourt (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/564,929

(22) PCT Filed: Jul. 27, 2004

(86) PCT No.: PCT/FR2004/050357

§ 371 (c)(1),
(2), (4) Date: Sep. 11, 2006

(87) PCT Pub. No.: WO2005/013419

PCT Pub. Date: Feb. 10, 2005

(65) Prior Publication Data

US 2007/0080881 A1 Apr. 12, 2007

(30) Foreign Application Priority Data

Jul. 30, 2003 (FR) ..... 03 09366

(51) Int. Cl.
*H01Q 13/12* (2006.01)

(52) U.S. Cl. ..... 343/769; 343/767

(58) Field of Classification Search ..... 343/767, 343/769

See application file for complete search history.

(56) References Cited

U.S. PATENT DOCUMENTS 3,665,480 A 5/1972 Fassett (Continued)

FOREIGN PATENT DOCUMENTS

EP 0 271 458 A2 6/1988

(Continued)

OTHER PUBLICATIONS

H. Arai et al: "Flat antennas for indoor cellular system", Digest of the Antennas and Propagation Society International Symposiu,, Seattle, WA., Jun. 19-24, 1994, vol. 3, Jun. 20, 1994, pp. 344-347.

(Continued)

*Primary Examiner*—Douglas W Owens
*Assistant Examiner*—Dieu Hien T Duong
(74) *Attorney, Agent, or Firm*—Robert D. Shedd; Joseph J. Opalach; Brian J. Cromarty

(57) ABSTRACT

The invention relates to a planar antenna realised on a substrate comprising a slot of closed form dimensioned to operate at a given frequency in a short-circuit plane of at least one feed-line. The perimeter of the slot being designed such that p=kλs where k is a whole number greater than 1 and λs the guided wavelength in the slot, the antenna comprising at least one first feed-line placed in an open circuit zone of the slot and a second feed-line placed at a distance d=(2n+1)λs/4 from the first line, where n is an integer greater than or equal to zero.

13 Claims, 7 Drawing Sheets

U.S. PATENT DOCUMENTS

| | | | | |
|---|---|---|---|---|
| 5,892,487 | A * | 4/1999 | Fujimoto et al. | 343/840 |
| 6,219,002 | B1 | 4/2001 | Lim | |
| 6,798,386 | B1 | 9/2004 | Louzir | |
| 7,027,001 | B2 * | 4/2006 | Thudor et al. | 343/769 |

FOREIGN PATENT DOCUMENTS

| | | | |
|---|---|---|---|
| EP | 1291971 | | 3/2003 |
| JP | 63135003 | A | 6/1988 |
| JP | 2-94906 | | 4/1990 |
| JP | 3-254208 | | 11/1991 |
| JP | 8242119 | A | 9/1996 |
| JP | 8509848 | T | 10/1996 |
| JP | 11298230 | A | 10/1999 |

OTHER PUBLICATIONS

Search Report dated Dec. 6, 2004.

* cited by examiner

DIVERSITY RECEPTION SLOTTED FLAT-PLATE ANTENNA

This application claims the benefit, under 35 U.S.C. 365 of International Application PCT/FR2004/050357, filed Jul. 27, 2004, which was published in accordance with POT Article 21(2) on Feb. 10, 2005 in French and which claims the benefit of French patent application No. 03 09360, filed on Jul. 30, 2003.

The present invention relates to a planar antenna with diversity of radiation. It relates more particularly to an antenna that can be used in the field of wireless transmissions, particularly within the framework of transmissions in a closed or semi-enclosed environment such as domestic surroundings, gymnasiums, television studios, theatres or similar rooms.

BACKGROUND OF THE INVENTION

In the known high-speed wireless transmission systems, the signals transmitted by the transmitter reach the receiver by following a plurality of paths resulting from the many reflections of the signal on the walls, furniture or similar elements. When combined at the level of the receiver, the phase differences between the different rays having taken paths of different lengths gives rise to an interference figure that can cause fading or a significant degradation in the signal.

Now, the location of the fading changes over time according to the modifications in the environment such as the presence of new objects or the movement of people. The fading due to multipaths can lead to significant degradations both at the level of the quality of the signal received and at the level of the system performances. To overcome these fading phenomena, the technique most often used is a technique that implements spatial diversity.

This technique consists, among other things, of using a pair of antennas with wide spatial coverage connected by feed-lines to a switch. However, the use of this type of diversity requires a minimum spacing between the radiating elements to ensure that there is sufficient decorrelation of the channel response viewed from each radiating element. An inherent disadvantage to its implementation is the distance between the radiating elements that present a cost, particularly in terms of size and substrate.

Other solutions have been proposed to overcome this problem. Some of these solutions use diversity of radiation as described for example in the French patent A-2 828 584 in the name of the applicant.

BRIEF SUMMARY OF THE INVENTION

The present invention proposes a new planar type antenna with diversity of radiation.

Hence, the present invention relates to a planar antenna realised on a substrate comprising a slot of closed shape dimensioned to operate at a given frequency in a short-circuit plane of at least one feed-line. In this antenna, the perimeter of the slot is designed such that $p=k\lambda s$ where k is a integer greater than 1 and $\lambda s$ the guided wavelength in the slot. Moreover, it comprises at least a first feed-line placed in an open circuit zone of the slot and a second feed-line placed at a distance $d=(2n+1)\ \lambda s/4$ from the first line, where n is an integer greater than or equal to zero.

According to a first embodiment, each feed-line terminates in an open circuit and is coupled to the slot according to a line/slot coupling such that the length of the line after the transition equals $(2k'+1)\lambda m/4$ where $\lambda m$ is the guided wavelength under the line and k' a positive or null integer. The line/slot coupling can also be realised in such a manner that the microstrip line terminates in a short-circuit located at $2k''\lambda m/4$ where $\lambda m$ is the guided wavelength under the line and k" is a positive or null integer.

According to a second embodiment, each feed-line is coupled magnetically with the slot according to a tangential line/slot transition.

Moreover, the shape of the slot can be annular, square, rectangular, polygonal, or in the form of a clover leaf. If the slot is of a rectangular shape, the feed-lines can be equidistant from an axis of symmetry of the slot or one of the feed-lines is positioned according to an axis of symmetry of the slot.

BRIEF DESCRIPTION OF THE DRAWINGS

Other characteristics and advantages of the present invention will emerge upon reading the following description of different embodiments, this description being made with reference to the drawings attached in the appendix, in which.

DESCRIPTION OF PREFERRED EMBODIMENTS

To simplify the description, the same elements have the same references as the figures.

Figure 1:
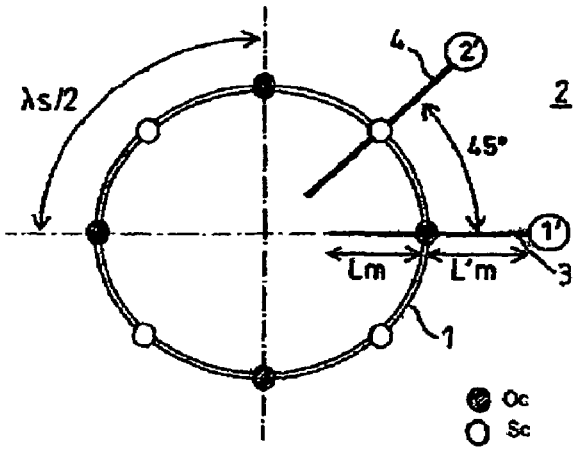
FIG. 1 is a diagrammatic top plan view of a first embodiment.

FIGS. 1 to 5 relate to a first embodiment of the invention. As shown in FIG. 1, the planar antenna is constituted by an annular slot 1 realised on a substrate 2 by engraving on a ground plane that is not shown. The antenna operates on a higher order mode, more particularly on its first higher order mode. Therefore, the perimeter of the annular slot 1 is equal to $2\lambda s$, where $\lambda s$ is the guided wavelength in the slot. Generally, the perimeter of the slot is such that $p=k\lambda s$ where $k>1$.

As shown in FIG. 1, the excitation of the slot is achieved by using a feed-line 3 realised in microstrip technology. The line 3 crosses the slot so as to obtain a coupling between the microstrip line and the slot according to the method described by Knorr. Thus, the length Lm of the line 3 equals approximately (2k'+1) λm/4 where km is the guided wavelength under the line and k' a positive or null integer, the most frequently Lm=λm/4. Moreover, as shown in FIG. 1, the distribution of the fields in the annular slot has maximum field zones (OC zones for Open Circuit) and minimum field zone (SC zones for Short-Circuit). The feed-line 3 crosses the annular slot 1 in an open circuit zone. Owing to the positioning of the feed-line and the perimeter of the annular slot, the distance between two OC zones or two SC zones is λs/2. This distribution of fields in the slot determines the radiation pattern of the antenna. The radiation is in the plane of the substrate, in contrast to the annular slot operating in its fundamental mode, for which the radiation is perpendicular to the substrate. According to one variant, the feed-line 3 terminates in a short-circuit. In this case, the length of the line (Lm) is chosen such that Lm=k"λm/4, where k" is a positive or null integer.

In accordance with the invention, a second feed-line 4 realised in microstrip technology and crossing the slot according to the Knorr method is positioned at the level of a SC zone. The length of the feed-line 4 is determined according to the rules mentioned above. Thus, when the access is realised by line 4, a second radiation pattern is obtained that is complementary to the first one. More specifically, the second line is located at +/−45° or +/−135° with respect to the first line, namely at a distance d such that d=(2n+1) λs/4. This relative position of the two accesses enables a good level of isolation to be obtained.

The dimensions taken for an embodiment compliant with that of FIG. 1, which was simulated by using the IE3D software of the Zeland company, will be given below. On a Rogers R04003 substrate presenting a εr=3.38, a loss tangent Tan Δ=0.0022 and a height H=0.81 mm, was realised an antenna such as represented in FIG. 1. This antenna is constituted by an annular slot presenting an internal diameter Rint=13.4 mm and an external diameter Rext=13.8 mm, namely an average diameter Ravg=13.6 mm. The width of the slot equals Ws=0.4 mm. The feed-lines are realised using microstrip technology and have a width Wm=0.3 mm and length Lm=λm/4 such that Lm=Lm'=8.25 mm.

Figure 2:
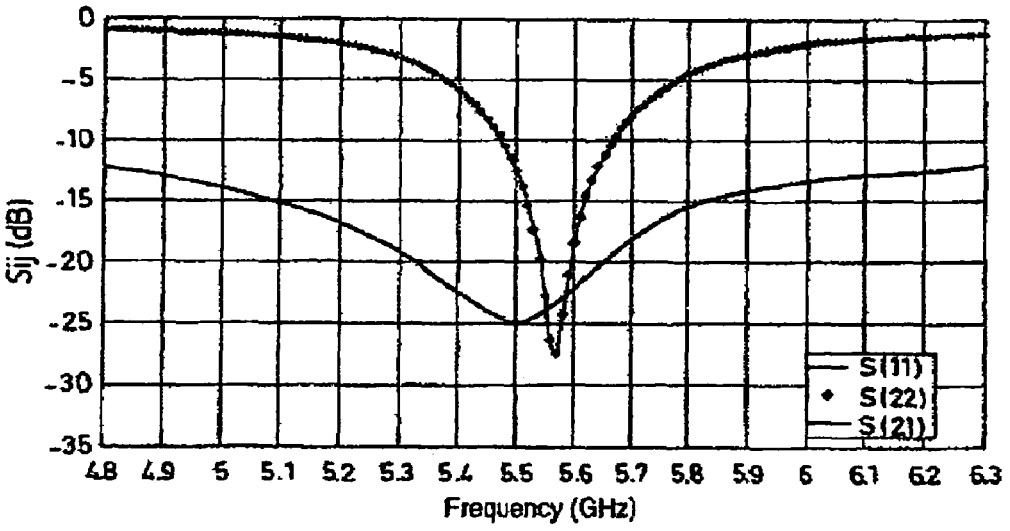
FIG. 2 is a curve showing the antenna parameters of FIG. 1.

As shown in FIG. 1, the distance between the two accesses 1' and 2', when the slot is a circle, corresponds to $1/8^{th}$ of the perimeter namely 2πraverage/8=10.68 mm. This corresponds to a quarter guided wavelength in the slot (λs/4=10.66 mm). At the level of accesses 1' and 2' for feeding the lines 3, 4, the impedance is 50 ohms. FIG. 2 shows the results obtained concerning the isolation S and matching parameters according to the frequency. It is seen in this case that an isolation of around −20 dB is obtained.

Figure 3A:
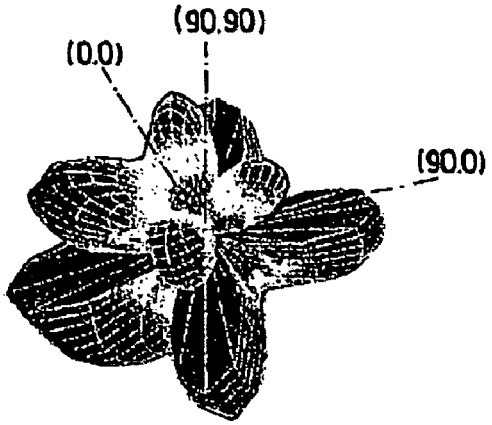
FIGS. 3*a* and 3*b* respectively show the radiation patterns of the antenna of FIG. 1 when is its fed respectively by the access 1 or by the access 2.
Figure 3B:
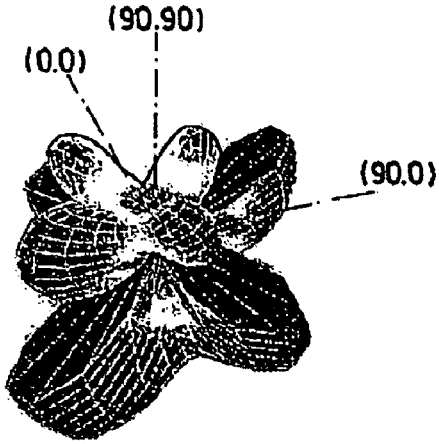
Figure 4:
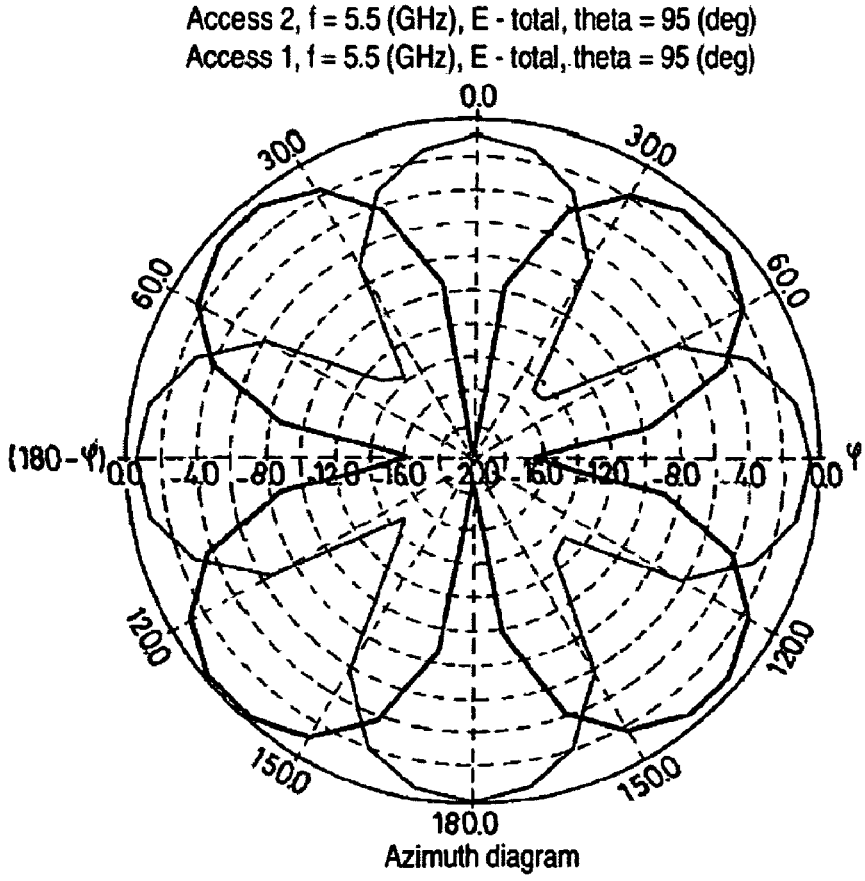
FIG. 4 is a cross-section of the radiation patterns of the FIG. 3.

Moreover, according to the radiation patterns shown in FIGS. 3*a* and 3*b*, four lobes oriented according to directions Ox and Oy are distinguished when the access 1' is used, as shown in FIG. 3*a* whereas when access 2' is used, the lobes are turned by 45°, as shown in FIG. 3*b*. Therefore two complementary radiation patterns are obtained, as shown in FIG. 4 which shows a cross-section in the plane θ=95° of the radiation patterns shown in FIGS. 3*a* and 3*b*.

It should also be noted that with this antenna, the radiation is produced in the plane of the substrate, which enables a horizontal coverage to be obtained for a single stage use, for example.

Figure 5:
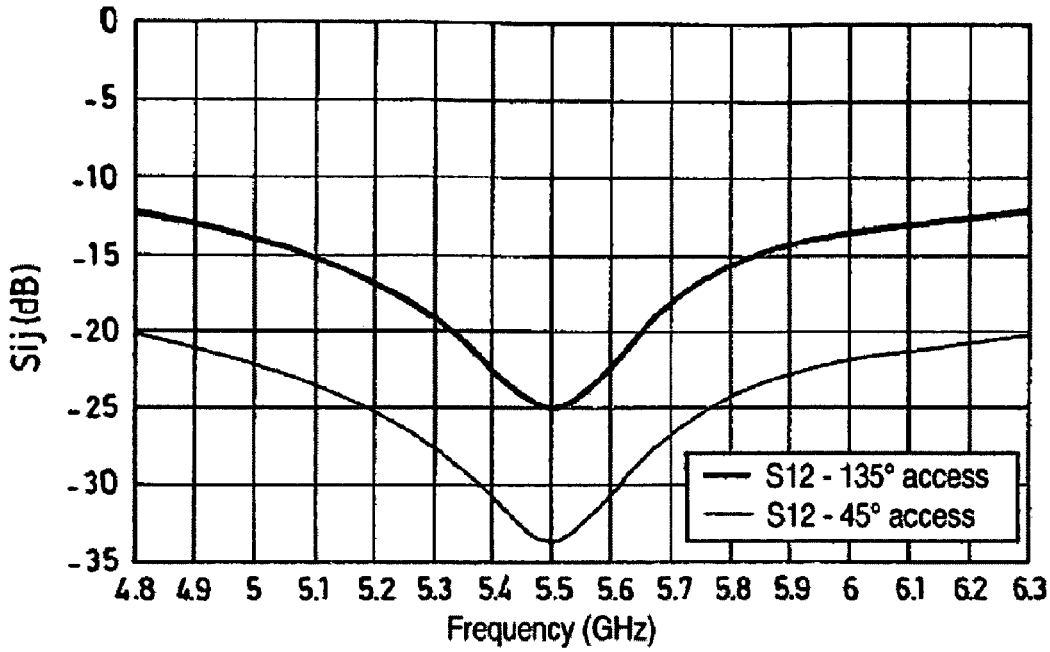
FIG. 5 shows the isolation curves S12 for a second access at 45° or 135°.

In accordance with the present invention, the second access, namely the microstrip line 4, can be placed at +/−135° (+/−3λs/4) in relation to the first access, namely the feed-line 3. This enables an improvement of approximately 8 dB in the isolation level to be obtained, as shown in FIG. 5 between the two curves S12 (135° access) and S12 (45° access).

Figure 6:
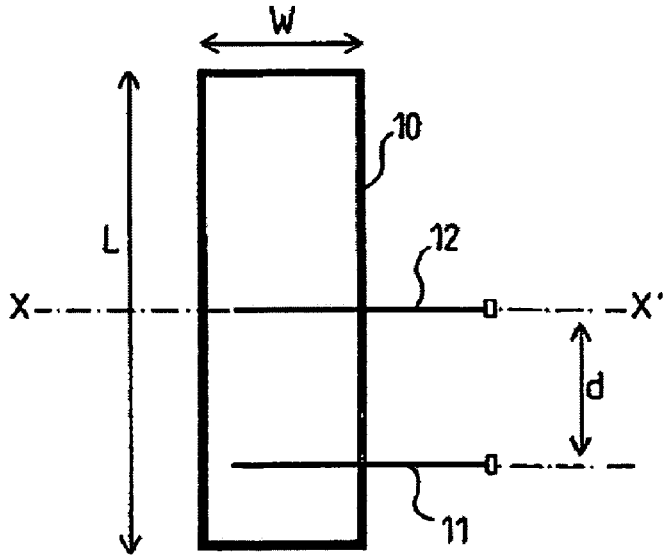
FIG. 6 is a diagrammatic top plan view of another embodiment of an antenna in accordance with the invention.

A description will now be given, with reference to FIGS. 6 to 8, of another embodiment of an antenna in accordance with the present invention. In this case, as shown in FIG. 6, instead of having a circular shaped slot, a slot 10 of rectangular shape is used. The length of the rectangular shape is such that p=2λs=2(W+L) where W corresponds to the width of the rectangle and L to the length of the rectangle. More generally, p=kλs=2(W+L). In this case, as shown in FIG. 6, the rectangular shaped slot is fed by two feed-lines 11 and 12 realised using microstrip technology. The feed is produced by line/slot coupling according to the method described by Knorr and mentioned above.

In accordance with the invention, the first feed-line 12 is positioned on an axis of symmetry of the structure, namely the axis x, x' whereas the second feed-line, namely line 11 is positioned at a distance d=(2n+1) λs/4 where n is an integer greater than or equal to zero. In these conditions, access to the feed-line 11 is not obtained by symmetry of the axis realised by the feed-line 12. This asymmetry is located at the level of the impedance matching of the ports. Indeed, an imbalance occurs between the S11 and S22 impedance matching in terms of central frequency and impedance matching band.

In this case, the frequency can be recentered by modifying the quarter wave (Lm'Wm') located between the access port and the line-slot transition as will be explained below.

Figure 7A:
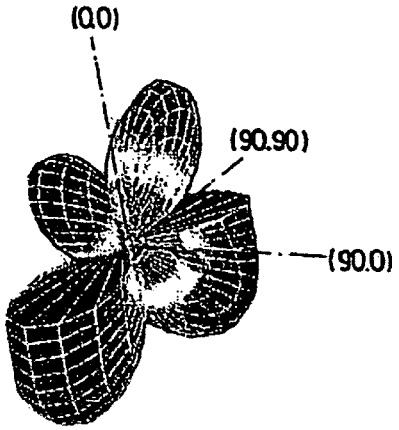
FIGS. 7*a* and 7*b* respectively show the radiation patterns of the antenna of FIG. 6 when it is fed respectively by the access 1 or by the access 2.
Figure 7B:
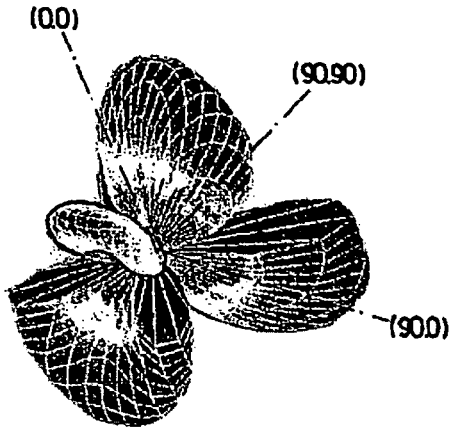

With a rectangular shape as shown in FIG. 6, the radiation patterns as shown in FIG. 7*a* for feeding by line 12 or 7*b* for feeding by line 11 are obtained. It is observed that the patterns obtained are modified with respect to the pattern of a circular slot but remain complementary. Hence, through the shape of the slot, it is possible to control the radiation patterns.

The following describes a practical embodiment of an antenna as shown in FIG. 6. This antenna was simulated by using the IE3D software with the following dimensions in millimetres:

L=32.92 mm
W=11.24 mm
D=18.84 mm
Ws=0.4 mm
Lm=Lm'=8.85 mm
Wm=Wm'=0.15 mm.

Figure 8A:
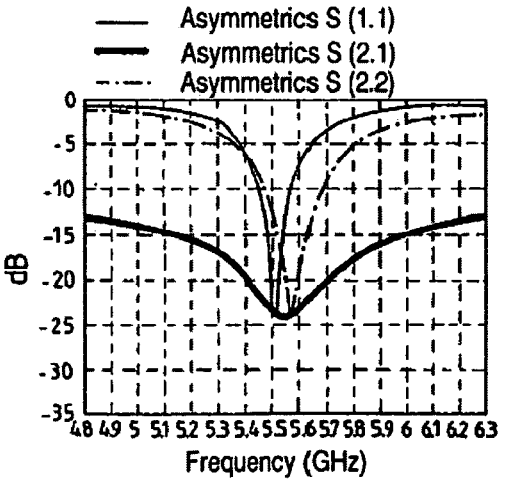
FIGS. 8*a* and 8*b* representing the parameters S of the antenna of FIG. 6 for different values of the quarter wavelength.
Figure 8B:
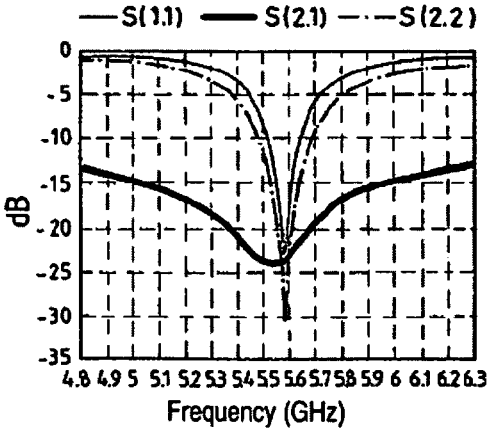

As shown in the curves of FIG. 8*a*, it is seen that in this case, there are two peaks of impedance matching that are not centred on the same frequency. To obtain a centring of the two peaks, the quarter wavelength of the access 1 was modified such that Lm'=7.85 mm and Wm'=0.75 mm. In this case, the parameters S of FIG. 8*b* were obtained. The quarter wave of the access corresponding to line 11 not having been modified, the two impedance matching peaks are centred on the same frequency.

A third embodiment will be described below with reference to FIGS. 9 to 11. In this case, the antenna constituted by a slot with a closed shape is realised by a rectangular slot 20 with two accesses formed by the feed-lines 21, 22 that are symmetrical in relation to the line x x'. With this symmetrical access structure, a balanced matching is obtained if the perimeter p of the rectangular slot is selected such that p=2λs=2(W+L) where W is the rectangle width and L its length, λs being the guided wavelength in the slot. As mentioned above, p can also be chosen such that p=kλs. Moreover, the distance between the access of the line 22 and the access of the line 21 is such that d=(2n+1) λs/4 where n is an integer greater than or equal to zero and the accesses formed by the lines 21 and 22 are equidistant from an axis of symmetry XX' of the rectangular slot.

Figure 10:
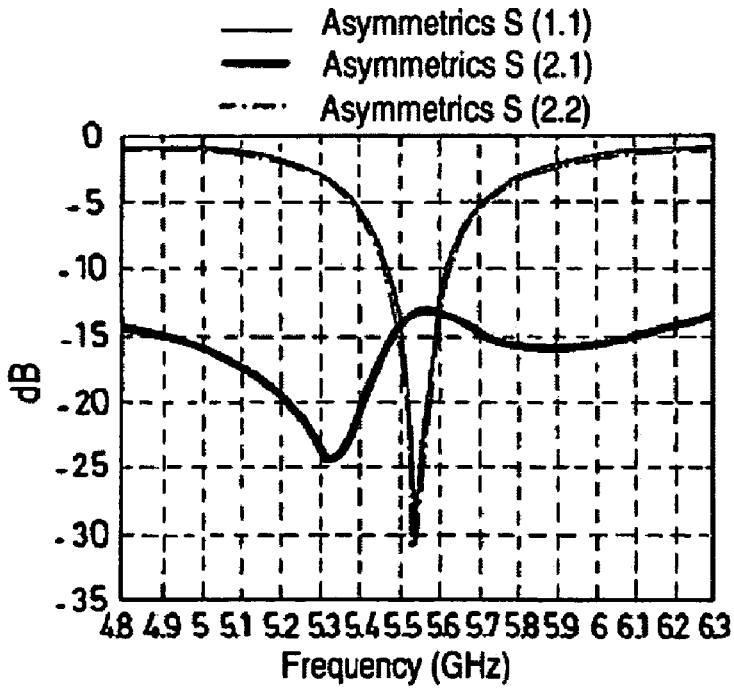
FIG. 10 shows the parameters S of the antenna of FIG. 9.

In this case, as shown in FIG. 10 which gives the parameters S of the rectangular slot with symmetrical accesses, the two impedance matching peaks are exactly superimposed but the level of isolation is higher for the antenna constituted by a rectangular slot with an asymmetrical access as shown in FIG. 6.

Figure 9:
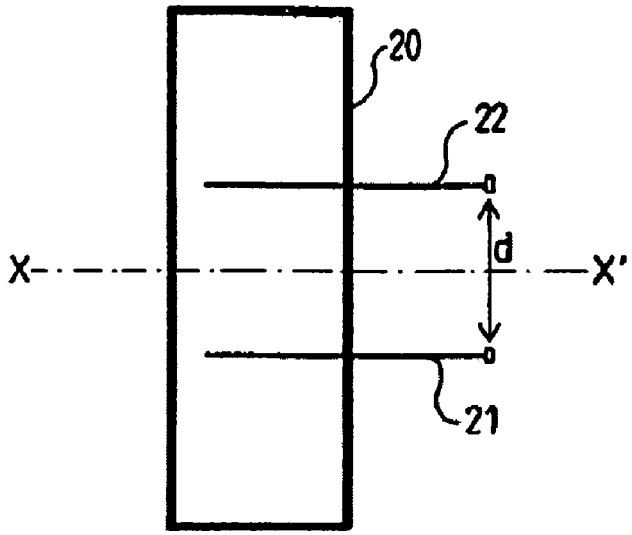
FIG. 9 is a diagrammatic top plan view of another embodiment of an antenna in accordance with the invention.
Figure 11A:
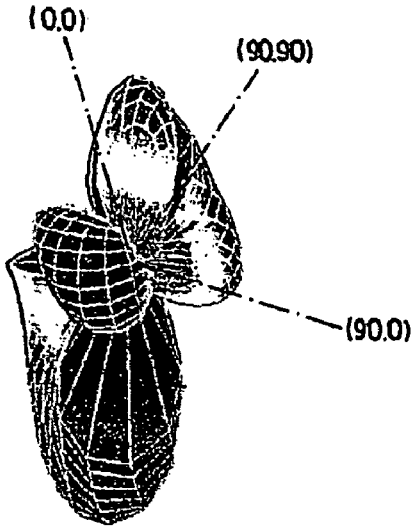
FIGS. 11*a* and 11*b* respectively show the radiation patterns of the antenna of FIG. 9.
Figure 11B:
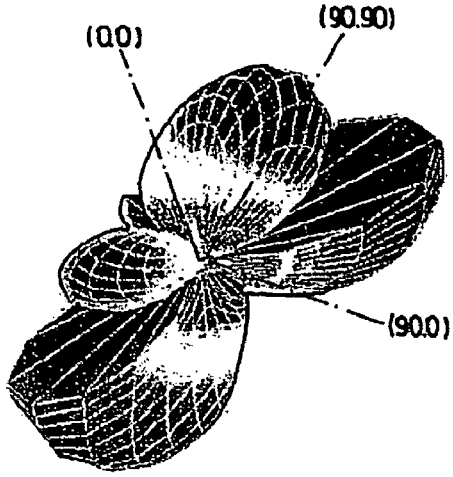

The antenna structure of FIG. 9 gives different radiation patterns according to the access used, as shown by the pattern of FIG. 11*a* and 11*b*.

Figure 12:
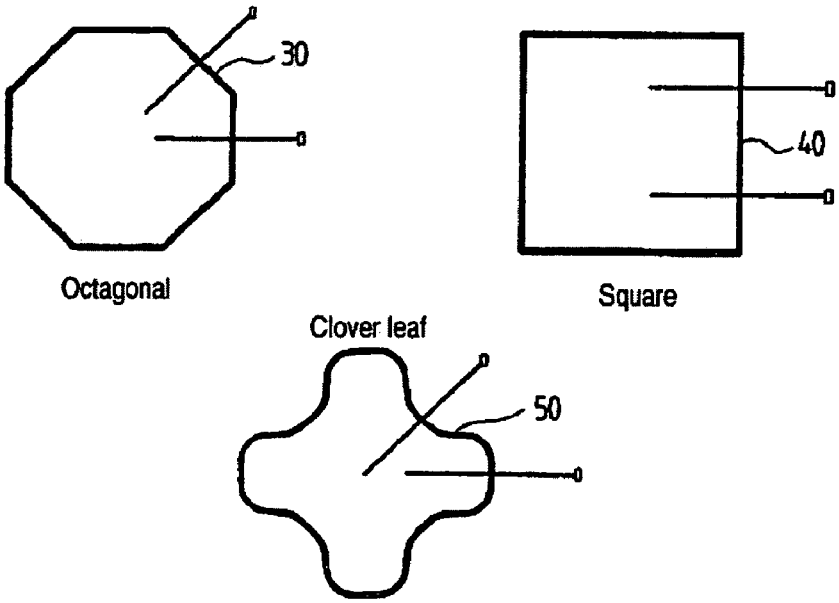
FIG. 12 is a diagrammatic plan view of diverse shapes for the antenna.

The embodiments shown above are related to planar antennas constituted by a slot of a closed, annular or rectangular shape. However, as shown in FIG. 12, other closed shapes can be used for the slot antenna, particularly an orthogonal shape 30, a square 40, a clover leaf shape 50. One of the operating conditions is that the perimeter of the slot is an integer multiple k greater than or equal to 2 of the guided wavelength in the slot $p=k\lambda s$ and that the distance d between the accesses is such that $d=2(n+1)\lambda s/4$ where n is an integer greater than or equal to zero.

In this case, a higher order mode of the slot is used, which enables complementary radiation patterns to be obtained. Particularly, the structures proposed radiate in the plane of the substrate, which is not the case with a slot antenna operating in its fundamental mode.

Figure 13:
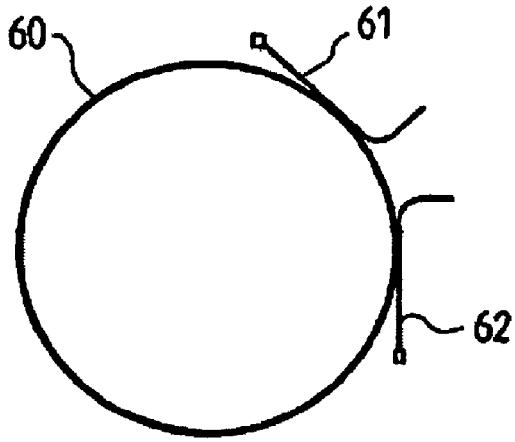
FIG. 13 is a diagrammatic plan view of yet another embodiment of the invention.

According to a variant of the present invention as shown in FIG. 13, the antenna-slot 60 that, in this embodiment, is constituted by a ring can be fed tangentially, as shown by the feed-lines 61, 62. In this case, the same design rules are used. The advantage of a tangential feed is to have feed-lines outside of the slot and to increase the bandwidth.

Figure 14:
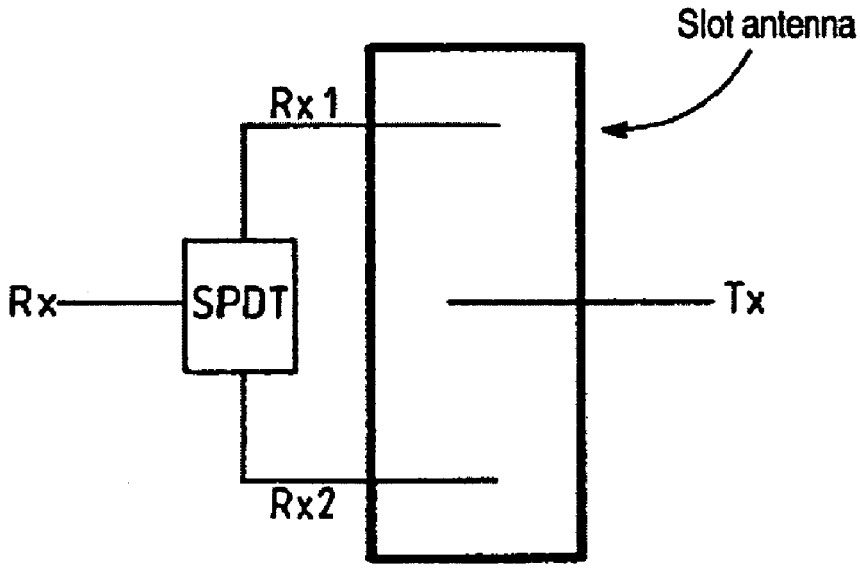
FIG. 14 is a diagrammatic view of an antenna in accordance with the invention integrating a Tx access and two Rx accesses.

In accordance with the present invention and as shown in FIG. 14, if the closed shape slot antenna is constituted particularly by a rectangle or a square, it is possible to realise a structure enabling a reception/transmission operation with a good isolation and a diversity of the order of 2 for reception. The Rx/Tx isolation obtained is that given in FIG. 8 in the case of a rectangular slot. The radiation pattern of the antenna fed by the access Tx corresponds to that of FIG. 7*a* and that of the antenna fed by access Rx1 corresponds to the pattern of FIG. 7*b*. Likewise the pattern of the antenna fed by the access Rx2 is symmetrical with respect to the axis Ox of the pattern represented in FIG. 7*b*. The distance between the two accesses Rx is $\lambda s/2$ or more generally $k'''\lambda s/2$ where k''' is an integer greater than 0. Hence, the isolation is not intrinsically good between these two accesses. A switching device such as the SPDT circuit will be used at the level of the Rx access.

The use of this type of structure thus enables a good level of isolation to be obtained and a diversity of order 2 for reception with very low overall dimensions when an integrated switching device is used.

It is evident to those in the profession that modifications can be made to the structures described above without falling outside the scope of the claims attached. In particular, the feed-lines can be realised using techniques other than the coplanar technology or coaxial cables, the outer core of which is connected to the substrate.

The invention claimed is:

1. A planar antenna with diversity of radiation realised on a substrate comprising a slot of closed shape dimensioned to operate on a mode higher than a fundamental mode and at least one feed-line coupled to said slot according to a line-slot transition, said antenna comprising a first feed-line coupled in a zone of the slot forming first open circuit and a second feed-line placed at an angle 45 degrees from said first feed-line, said second feed line being coupled in a zone of the slot forming a first short-circuit, said antenna further comprising means for selecting for an access either the first feed line, producing in the directions of main radiation a first radiation pattern, or the second feed line, producing in the directions of main radiation a second radiation pattern, said second radiation pattern being complementary of the first radiation pattern.

2. The antenna of claim 1, wherein the first and second feed-lines terminate in a second and third open circuits and are each coupled to the slot according to the line-slot transition, the length of each feed line after the line-slot transition being equal to $(2k'+1)\lambda m/4$ where $\lambda m$ is the guided wavelength in the each feed line and k' is a positive or null integer.

3. The antenna of claim 1, wherein each feed-line is coupled to the slot according to a line-slot transition with a microstrip line terminated by a second short-circuit, the length of each feed line after the line-slot transition being equal to $k''\lambda m/4$ where $\lambda m$ is the guided wavelength in the each feed line and k'' is a positive or null integer.

4. The antenna of claim 1, wherein the feed-lines are realised in microstrip technology or in coplanar technology.

5. The antenna of claim 1, wherein the shape of the slot is an annular, square, rectangular, polygonal shape or is in a clover leaf form.

6. The antenna of claim 5, wherein the slot is of rectangular shape and the feed-lines are equidistant from an axis of symmetry of the slot.

7. The antenna of claim 5, wherein the slot is of rectangular shape and one of the feed-lines is positioned according to an axis of symmetry of the slot.

8. The antenna of the claim 1, where the feed lines are connected to a transmission/reception means enabling a diversity of reception.

9. A planar antenna with diversity of radiation realised on a substrate comprising a slot of closed shape dimensioned to operate on a mode higher than a fundamental mode and at least one feed-line coupled to said slot according to a line-slot transition, the perimeter of the slot being selected such that $p=k\lambda s$ where p is the perimeter of the slot, k is an integer greater or equal to 2 and $\lambda s$ is the guided wavelength in the slot, said antenna comprising a first feed-line coupled in a zone of the slot forming first open circuit and a second feed-line placed at a distance $d=(2n+1)\lambda s/4$ from said first line, where n is an integer greater than or equal to zero, said second feed line being coupled in a zone of the slot forming a first short-circuit, wherein each feed-line is coupled magnetically to the slot according to a tangential line-slot transition.

10. The antenna of claim 9, wherein the feed-lines are realised in microstrip technology or in coplanar technology.

11. The antenna of claim 9, wherein the shape of the slot is an annular, square, rectangular, polygonal shape or is in a clover leaf form.

12. The antenna of claim 11, wherein the slot is of rectangular shape and the feed-lines are equidistant from an axis of symmetry of the slot.

13. The antenna of claim 9, where the feed lines are connected to a transmission/reception means enabling a diversity of reception.

* * * * *